US012240512B2

(12) United States Patent
McDonald et al.

(10) Patent No.: US 12,240,512 B2
(45) Date of Patent: Mar. 4, 2025

(54) FIXED SIGNAGE AND METHOD FOR USE OF SAME

(71) Applicant: RailPros Field Services, Inc., Irving, TX (US)

(72) Inventors: James McDonald, Irving, TX (US); Chad Smith, Irving, TX (US)

(73) Assignee: RailPros Field Services, Inc., Irving, TX (US)

( * ) Notice: Subject to any disclaimer, the term of this patent is extended or adjusted under 35 U.S.C. 154(b) by 681 days.

(21) Appl. No.: 17/621,826

(22) PCT Filed: Jun. 28, 2020

(86) PCT No.: PCT/US2020/040036
§ 371 (c)(1),
(2) Date: Dec. 22, 2021

(87) PCT Pub. No.: WO2020/264462
PCT Pub. Date: Dec. 30, 2020

(65) Prior Publication Data

US 2022/0355837 A1 Nov. 10, 2022

Related U.S. Application Data

(60) Provisional application No. 62/868,284, filed on Jun. 28, 2019.

(51) Int. Cl.
*B61L 5/12* (2006.01)

(52) U.S. Cl.
CPC ..... *B61L 5/125* (2013.01)

(58) Field of Classification Search
CPC ..... B61L 5/125; B61L 29/30; B61L 23/06
See application file for complete search history.

(56) References Cited

U.S. PATENT DOCUMENTS 5,416,996 A 5/1995 Clemens
5,485,693 A 1/1996 Frenken
(Continued)

FOREIGN PATENT DOCUMENTS

AU 2005202184 5/2005
CN 201514740 6/2010
(Continued)

OTHER PUBLICATIONS

Triplesign VMS Solar, https://www.triplesign.com/assets/pdf/Triplesign-VMS-Solar.pdf.
(Continued)

*Primary Examiner* — Jason C Smith
(74) *Attorney, Agent, or Firm* — Scott Griggs; Griggs Bergen LLP

(57) ABSTRACT

A fixed signage (10) and method for use of the same are disclosed. In one embodiment, a housing (22) having a window (24) is sized to house a sign (26) therein. A closure assembly (32), under the power of an actuator (112), is installed in the housing (22) to support a cover material (34). The cover material (34) is moveable by a moveable closure member (138) between a fully retracted position whereat the cover material (34) is contained within the housing (22) such that the window (24) is exposed to a fully extended position whereat the cover material (34) covers at least a portion of the window (24). A command signal (180) may be received via a transceiver (160) to remotely control the actuator (112) and cover material (34). A signal sensor (60) within the housing (22) indicates the location of the cover material (34).

10 Claims, 4 Drawing Sheets

(56) References Cited

U.S. PATENT DOCUMENTS

| | | | | |
|---|---|---|---|---|
| 5,918,924 | A | 7/1999 | Cowan | |
| 6,065,232 | A | 5/2000 | Haughey | |
| 6,128,841 | A | 10/2000 | Werner | |
| 6,148,555 | A | 11/2000 | Beauchamp | |
| 6,157,322 | A * | 12/2000 | Anderson | B61L 29/00 340/904 |
| 6,178,675 | B1 | 1/2001 | Strother | |
| 6,209,598 | B1 | 4/2001 | Petrey | |
| 6,594,930 | B1 | 7/2003 | Strauss | |
| 6,702,351 | B2 | 3/2004 | Buring | |
| 7,075,427 | B1 * | 7/2006 | Pace | B61L 23/06 246/126 |
| 7,121,026 | B2 | 10/2006 | Chen | |
| 7,163,108 | B2 | 1/2007 | Lyons | |
| 7,315,770 | B2 * | 1/2008 | Wade | B61L 29/00 701/19 |
| 7,333,277 | B1 | 2/2008 | Chen | |
| 7,571,559 | B2 | 8/2009 | Olsson | |
| 7,624,952 | B1 | 12/2009 | Bartek | |
| 7,882,653 | B2 | 2/2011 | Barlow | |
| 7,921,586 | B2 | 4/2011 | Reynolds | |
| 8,138,948 | B1 * | 3/2012 | Votava | G08G 1/07 340/916 |
| 8,157,219 | B2 * | 4/2012 | Ashraf | B61L 29/28 246/204 |
| 8,250,793 | B1 | 8/2012 | Halula | |
| 8,312,676 | B2 | 11/2012 | Maciulewicz | |
| 8,477,081 | B2 | 7/2013 | Daniel | |
| 8,880,237 | B2 * | 11/2014 | Boss | G08G 1/096716 701/1 |
| 9,805,611 | B2 * | 10/2017 | Campbell | G09F 19/22 |
| 9,822,927 | B2 | 11/2017 | Frederick | |
| 10,283,019 | B2 | 5/2019 | Ballow | |
| 11,545,055 | B2 * | 1/2023 | Castillo | G09F 13/22 |
| 11,568,770 | B2 * | 1/2023 | Gardner | G09F 13/20 |
| 12,067,830 | B2 * | 8/2024 | Chambers | G07F 17/3213 |
| 2003/0236598 | A1 | 12/2003 | Villarreal Antelo | |
| 2004/0093777 | A1 | 5/2004 | Park | |
| 2005/0178928 | A1 | 8/2005 | Wade | |
| 2007/0146152 | A1 | 6/2007 | Welles | |
| 2007/0199216 | A1 | 8/2007 | Atkinson | |
| 2008/0073169 | A1 | 3/2008 | Walters | |
| 2008/0084333 | A1 | 4/2008 | Forrest | |
| 2008/0169385 | A1 * | 7/2008 | Ashraf | B61L 29/22 246/130 |
| 2008/0195312 | A1 | 8/2008 | Aaron | |
| 2010/0146830 | A1 | 6/2010 | Large | |
| 2011/0006912 | A1 | 1/2011 | Sheardown | |
| 2011/0118913 | A1 | 5/2011 | Pretorius | |
| 2011/0127389 | A1 | 6/2011 | Bartek | |
| 2012/0198739 | A1 | 8/2012 | Venetucci | |
| 2012/0320204 | A1 | 12/2012 | Dahlin | |
| 2013/0289873 | A1 | 10/2013 | Mitchell | |
| 2014/0249877 | A1 | 9/2014 | Hull | |
| 2017/0088046 | A1 | 3/2017 | Denny | |
| 2017/0287368 | A1 | 10/2017 | Harter | |
| 2018/0181992 | A1 | 6/2018 | Akhavan-Saraf | |
| 2018/0247137 | A1 | 8/2018 | Boyle | |
| 2022/0184905 | A1 * | 6/2022 | Grebe | B29C 71/02 |
| 2022/0237571 | A1 * | 7/2022 | McDonald | G06Q 10/0635 |
| 2022/0355837 | A1 * | 11/2022 | McDonald | B61L 23/06 |
| 2023/0131671 | A1 * | 4/2023 | Alecoeur | B60Q 1/549 340/468 |
| 2024/0071266 | A1 * | 2/2024 | Gady | G09F 13/22 |

FOREIGN PATENT DOCUMENTS

| | | | | |
|---|---|---|---|---|
| CN | 202662247 | | 1/2013 | |
| CN | 104537837 | | 4/2015 | |
| CN | 104715625 | | 6/2015 | |
| CN | 112323673 | | 2/2021 | |
| EP | 0592208 | | 4/1994 | |
| GB | 2506906 | A * | 4/2014 | G09F 13/04 |
| GB | 2615514 | A * | 8/2023 | B60Q 1/50 |
| JP | 5745928 | | 5/2015 | |
| KR | 101446063 | | 9/2014 | |
| WO | 2009055875 | | 5/2009 | |
| WO | 2018080382 | | 5/2018 | |
| WO | 2020264462 | | 12/2020 | |
| WO | 2020264477 | | 12/2020 | |
| WO | 2020264520 | | 12/2020 | |

OTHER PUBLICATIONS

Rotating Panel Billboard, Trivision, Trivision Billboard Advertising, Mobile Billboard, https://www.youtube.com/watch?v=ddPn5AN9vqY.

* cited by examiner

FIXED SIGNAGE AND METHOD FOR USE OF SAME

TECHNICAL FIELD OF THE INVENTION

This invention relates, in general, to signage and, in particular, to fixed signage and a method for use of the same that provides visual indications furnishing instructions and guidance at locations undergoing maintenance, construction, or the like.

BACKGROUND OF THE INVENTION

On railroads, signs are utilized to protect trains, train crews, contractors, and anyone performing work within a railway right-of-way. When a train approaches a location having a sign posted, the sign informs the train crew what, if any, steps need to be taken when passing the area. Railway signs during extensive maintenance and construction may include dozens to hundreds of signs installed along vast sections of track and adjacent roadway. The signs inform train crews and drivers of the conditions and provide guidance that prioritizes safety. During such maintenance and construction, railway workers are frequently assigned the task of covering and uncovering signs temporarily along a distance of track. Typically, railway workers use burlap sacks to cover the signs. Not only is the covering and uncovering labor intensive, but the burlap sacks are difficult to secure in high winds and subject to degradation in the elements. These practices have been in place for decades despite technology improvements in many other areas. As a result, there is a need for improved fixed signs.

SUMMARY OF THE INVENTION

It would be advantageous to achieve technology improvements in the area of fixed signs. It would also be desirable to enable an electro-mechanical-based solution that would enable remote management and oversight of fixed signs. To better address one or more of these concerns, a fixed signage and a method for use of the same are disclosed. In one embodiment of the fixed signage, a housing having a window is sized to house a sign therein. A closure assembly, under the power of an actuator, is installed in the housing to support a cover material. The cover material is moveable by a moveable closure member between a fully retracted position whereat the cover material is contained within the housing such that the window is exposed to a fully extended position whereat the cover material covers at least a portion of the window. A command signal may be received via a transceiver to remotely control the actuator and cover material. A sensor within the housing indicates a location of the cover material.

In another embodiment of the fixed signage, a housing having a window is sized to house a sign therein. The sign is secured within the housing and a signifier is visible via the window. The sign is mounted to a post with fasteners secured thereto through the rear of the housing. A closure assembly, under the power of an actuator, is installed in the housing to support a cover material. The cover material is moveable by a moveable closure member between a fully retracted position whereat the cover material is contained within the housing such that the window is exposed to a fully extended position whereat the cover material covers at least a portion of the window. A command signal may be received via a transceiver to remotely control the actuator and cover material. A sensor within the housing indicates a location of the cover material. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
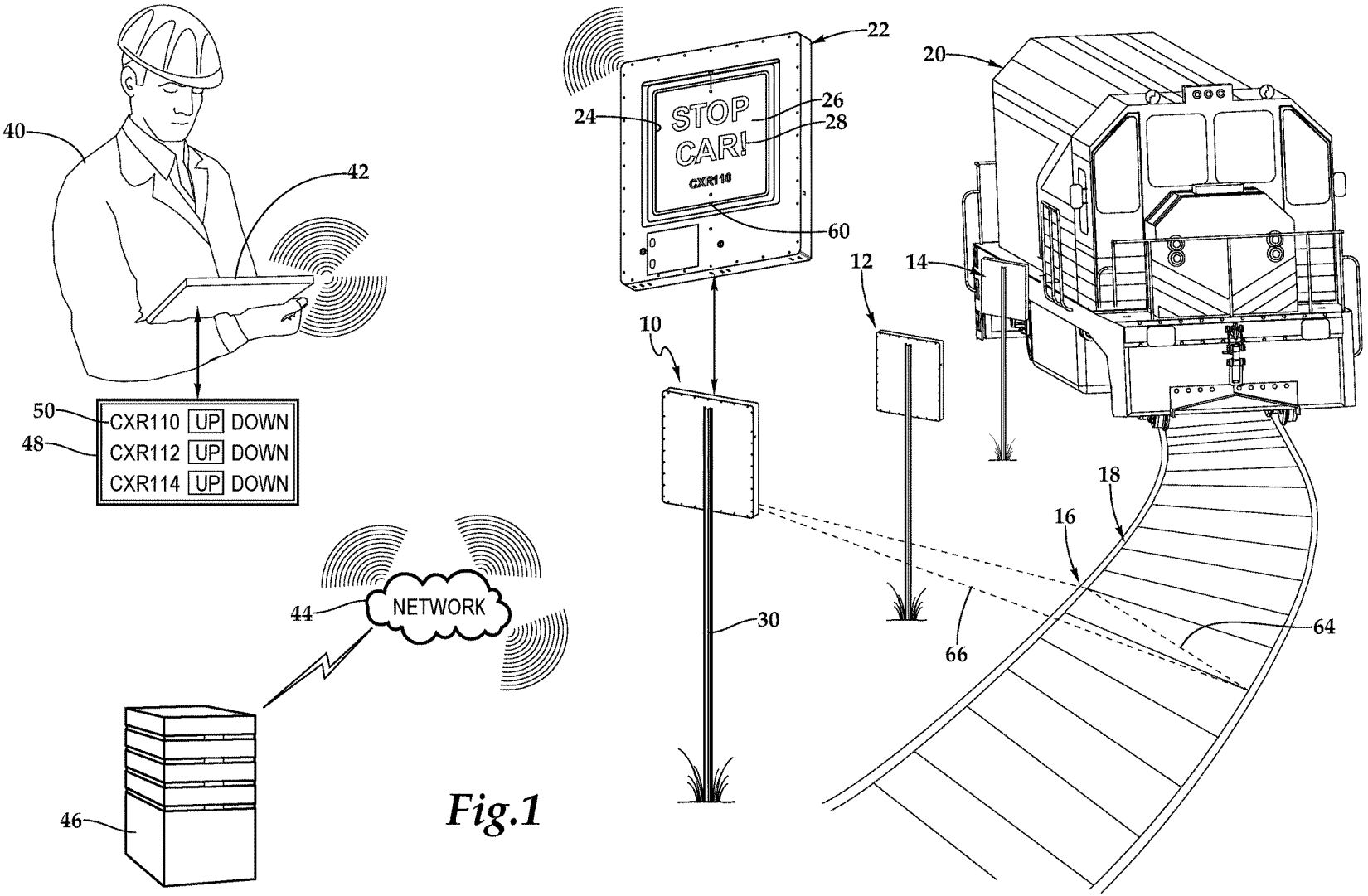
FIG. 1 is a schematic diagram depicting one embodiment of fixed signage being utilized in a railway environment according to the teachings presented herein.
Figure 2A:
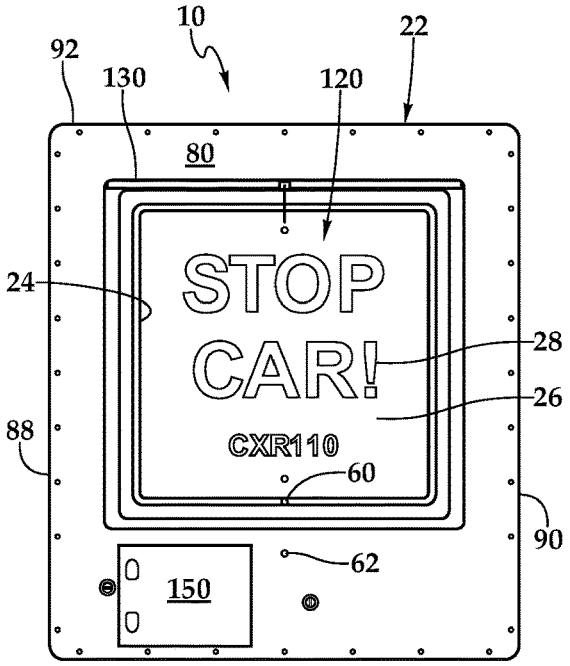
FIG. 2A is a front elevation view depicting one embodiment of the fixed signage depicted in FIG. 1 in an open presentation.
Figure 2B:
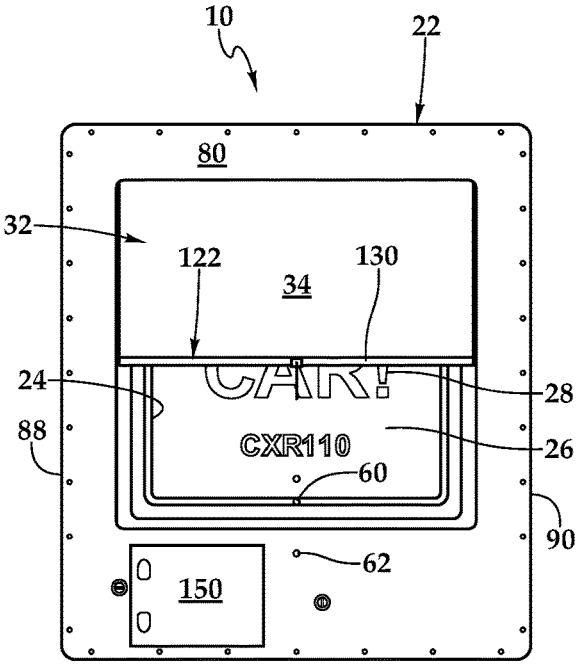
FIG. 2B is a front elevation view depicting one embodiment of the fixed signage depicted in FIG. 1 in a semi-open presentation.
Figure 2C:
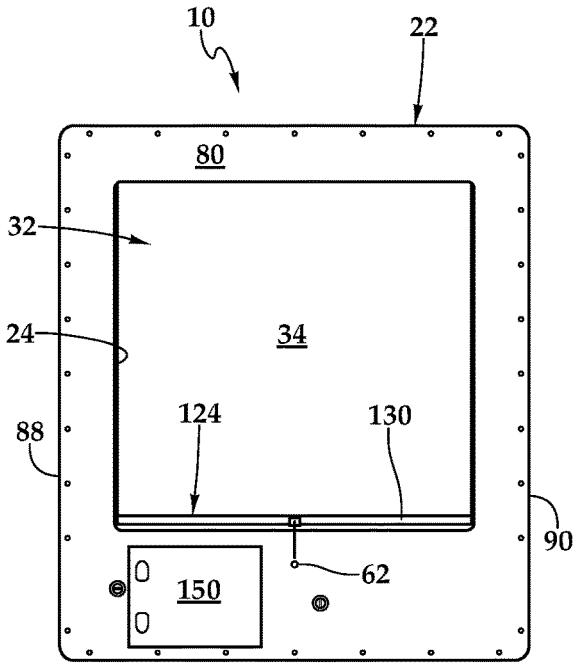
FIG. 2C is a front elevation view depicting one embodiment of the fixed signage depicted in FIG. 1 in a closed presentation.
Figure 3:
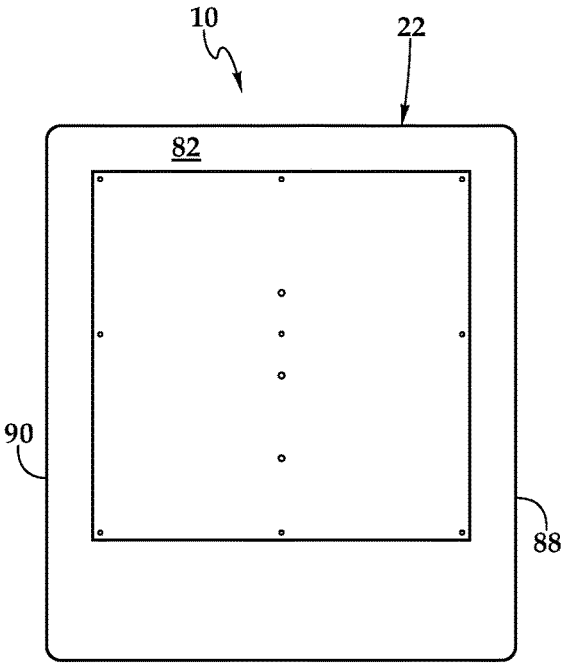
FIG. 3 is a rear elevation view depicting the fixed signage of FIG. 1.
Figure 4:
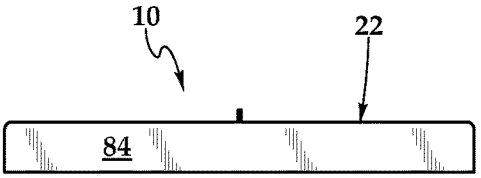
FIG. 4 is a top plan view depicting the fixed signage of FIG. 1.
Figure 5:
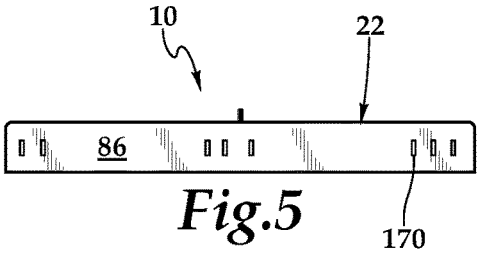
FIG. 5 is a bottom plan view depicting the fixed signage of FIG. 1.
Figures 6A, 6B:
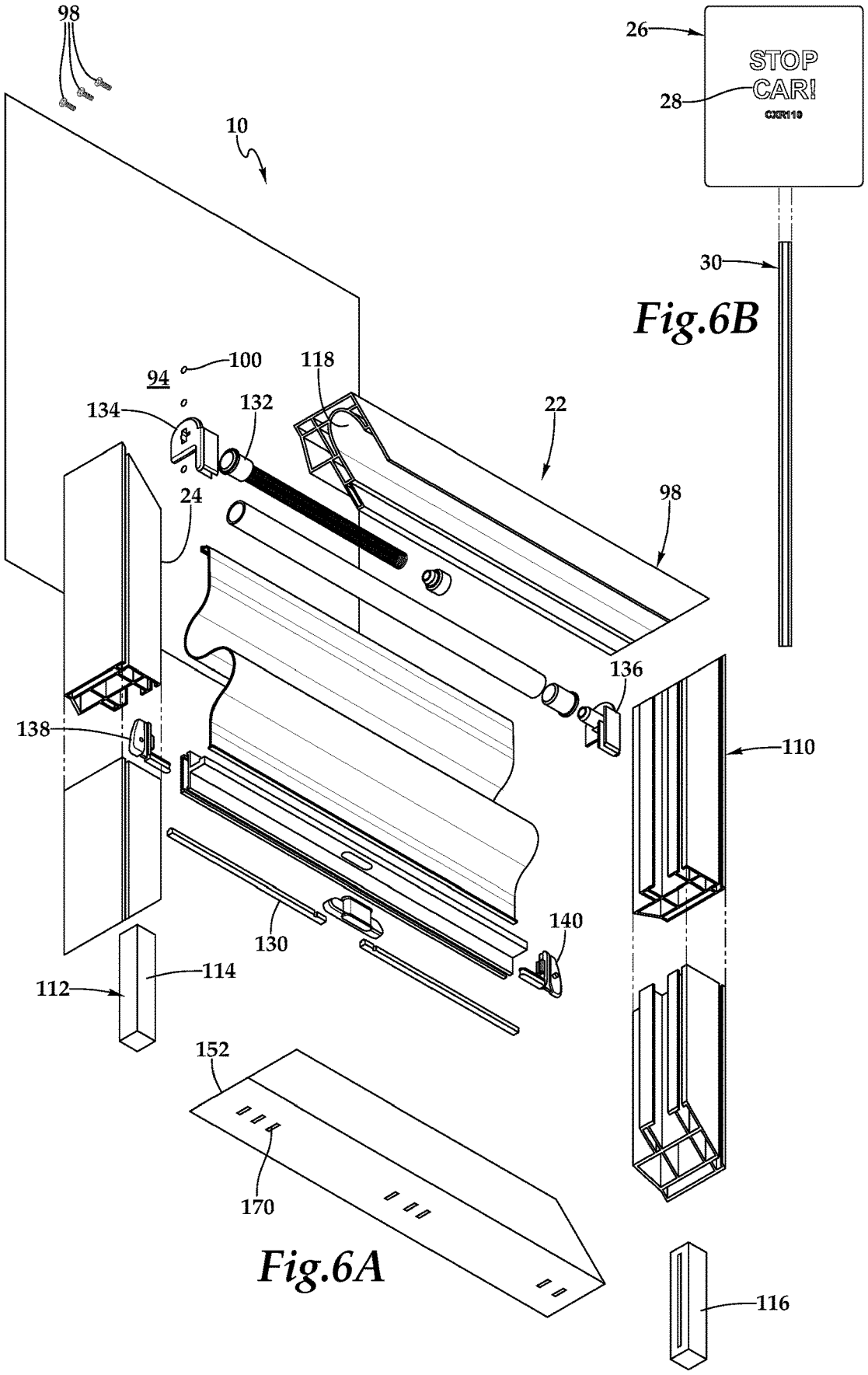
FIG. 6A is an exploded view depicting the fixed signage of FIG. 1.
FIG. 6B is an exploded view depicting the sign of FIG. 1.

Referring initially to FIG. 1, therein is depicted one embodiment of fixed signage 10, 12, 14. The fixed signage 10, 12, 14 is located in a railway right-of-way 16 proximate a railroad track 18 having a train 20 thereon. It should be appreciated that although three instances of fixed signage 10, 12, 14 are depicted, railway signs during extensive maintenance and construction may include dozens to hundreds of signs installed along the rail right-of-way 16. The signage informs train crews and drivers of the conditions and provides guidance that prioritizes safety. The fixed signage 10 includes a housing 22 having a window 24. The housing 22 is sized to house a sign 26 having a signifier 28 therein. The sign 26 is secured to the ground by a post 30. A closure assembly 32 (See FIGS. 2B-2C) is installed in the housing 22 to support a cover material 34 (See FIGS. 2B-2C). The cover material 34 is moveable between a fully retracted position whereat the cover material 34 is contained within the housing 22 such that the window 24 is exposed to a fully extended position whereat the cover material 34 covers at least a portion of the window 24. The fixed signage 12, 14 may be similar in structure and function to the fixed signage 10.

As the train 20 approaches the location having the fixed signage 10, for example, the signifier 28 on the sign 26 informs the train crew what, if any, steps need to be taken when passing the area. In this instance, the fixed signage 10 indicates that the train 20 should stop. During maintenance and construction operations as depicted in FIG. 1, railway workers, such as railway worker 40, are assigned the task of covering and uncovering signs temporarily along the railway right-of-way 16. As shown, the railway worker 40 is remotely located with a smart device 42 in communication with the fixed signage 10, 12, 14 via a network 44. Additionally, a server 46 is located in communication with the fixed signage 10, 12, 14 via the network 44. As will be described in further detail, the railway worker 40 utilizes the smart device 42 to remotely actuate the covering or uncovering of the sign 26 via the signage as well as manage the signage. By way of example, a display 48 on the smart device 42, includes sign details 50, such as the location of a particular sign and the status of the cover material 34 of the signage (UP or DOWN) with the status indicators being actionable to change the status of the signage. It should be appreciated that the particular graphical user interface shown on the display 48 is exemplary and other presentations and graphical user interfaces are within the teachings presented herein.

Not only does the use of the smart device 42 mitigate the labor required in the covering and uncovering operations, but the fixed signage 10 includes various failsafe measures to ensure appropriate covering and uncovering, e.g., the desired position of the cover material 34 over the sign 26 and window 24. Alternatively, the server 46 may be utilized to remotely actuate the covering or uncovering of the sign 26 via the fixed signage as well as manage the fixed signage. The use of the server 46 also mitigates the labor required in the covering and uncovering operations.

It should be appreciated, however, that the teachings presented herein are not limited to fixed signage related to performing work within a railway right-of-way on a railroad. More generally, the teachings presented herein are applicable to any industry using fixed signage that may be periodically covered and uncovered. Such industries include agricultural, manufacturing, construction, oil and gas, transportation, as well as service industries, including delivery and security. By way of example and not by way of limitation, with respect to the agricultural industry, in forestry, fixed signage may be deployed near and within a logging operation and require periodic covering and uncovering. In the manufacturing industry at a steel plant, signage may be deployed to provide guidance to drivers and the signage may be periodically covered and uncovered. By way of further example, in the road construction industry, the proximity sensors would be particularly beneficial to provide alerts if a vehicle passes a fixed sign when the vehicle should not pass.

More particularly, with respect to the various fail safe measures, which will be discussed in further detail hereinbelow, the fixed signage 10 includes a signal sensor 60 located within the housing 22 to sense a location of the cover material 34. It should be appreciated that the signal sensor 60 may include multiple signal sensors. Also, the fixed signage 10 includes a proximity sensor 62, which may be a rail sensor in some implementations, located within the housing 22. It should be appreciated that the proximity sensor 62 may include multiple proximity sensors. The proximity sensor 62 is oriented toward a sensing location 64 proximate the ground at the railroad track 18. The sensing location 64 is a railway right-of-way sign distance 66 away. The proximity sensor 62 monitors for a railway event, like the train 20 passing the signage 10.

Referring now to FIGS. 2A, 2B, 2C, 3, 4, 5, 6A, and 6B the housing 22 includes a front 80, a rear 82, a top 84, a bottom 86, and sides 88, 90. The housing 22 also includes an exterior 92 and an interior 94. The housing 22 may include a panel construction 96 that may be unitary or have multiple components. Further, it should be appreciated that the panel construction may vary from the panel construction 96 presented in FIGS. 2A through 6A. In the illustrated embodiment, the housing 22 is sized to house the sign 26, which may be railway sign or other type of sign, within the interior 94. The window 24 is located in the front 80 of the housing 22 such that the signifier 28 on the sign 26 is visible from the exterior 92 of the housing 22. The sign 26 is mounted to the post 30 with the fasteners 98 secured thereto through the rear 82 of the housing 22 by way of openings 100.

The closure assembly 32 includes a frame 110 that supports the cover material 34, which may be a flexible material. As previously discussed, the flexible material is moveable, under the power of an actuator 112 including actuator units 114, 116 between a fully retracted position whereat the cover material 34 is contained within a pocket 118 of the frame 110, as shown by an arrow 120, to a fully extended position whereat the cover material 34 covers some, as shown by an arrow 122, or all, as shown by an arrow 124, of the window 24.

In the illustrated embodiment, the cover material 34 is engaged with a draw bar 130 at the free end thereof and engaged with a spring biased roller 132 at the other end. The spring biased roller 132 is engaged with integral mounting brackets 134, 136 which form portions of the frame 110, to permit slidable installation and removal of the spring biased roller 132 assembly and the integral mounting brackets 134, 136 in mating engagement within the pocket 118 of the frame 110. The cover material 34 is moveable by a pair of moveable closure members 138, 140 contained within the integral mounting brackets 134, 136 under the power of the respective actuator unit 114, 116.

A door 150 in the front 80 of the housing 22 provides access to an electronics compartment 152, which may house a processor 154 (FIG. 7), memory 156 (FIG. 7), storage 158 (FIG. 7), a transceiver 160 (FIG. 7), an actuator input/output 162 (FIG. 7), the signal sensor 60, the proximity sensor 62, as well as a power source (not shown), which may be battery, capacitor, solar or a combination thereof. As discussed, the signal sensor 60 is located within the front 80 of the housing 22 and oriented to sense a location of the cover material 34. The proximity sensor 62 is also located within the front 80 of the housing 22, but is oriented toward the sensing location 64 proximate the ground at the railroad track 18 at a railway right-of-way sign distance 66 away. Drainage holes 170 are located in the bottom 86 of the housing 22 to permit any water that collects within the housing 22 to flow therethrough and drain.

Figure 7:
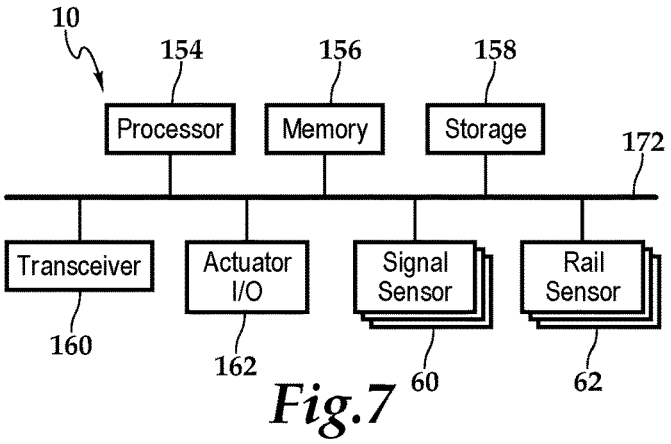
FIG. 7 is a functional block diagram depicting one embodiment of the fixed sign presented in FIG. 1.

Referring now to FIG. 7, within the housing 22, the fixed signage 10 includes the processor 154, the memory 156, the storage 158, the transceiver 160, the actuator input/output 162, the signal sensor 60, and the proximity sensor 62, which are interconnected by a busing architecture 172 within a mounting architecture. The processor 154 may process instructions for execution within the fixed signage 10 as a computing device, including instructions stored in the memory 156 or in the storage 158. The memory 156 stores information within the fixed signage 10 as a computing device. In one implementation, the memory 156 is a volatile memory unit or units. In another implementation, the memory is a non-volatile memory unit or units. The storage 158 provides capacity that is capable of providing mass storage 158 for the fixed signage 10. Various inputs and outputs provide connections to and from the fixed storage 10 as the computing device, wherein the inputs are the signals or data received by the processor 154 and the memory 156, and the outputs are the signals or data sent from the processor 154 and the memory 156. The various inputs and outputs include the transceiver 160, the actuator input/output 162, the signal sensor 60, and the proximity sensor 62.

The transceiver 160 is associated with the housing 22 and communicatively disposed with the busing architecture 172. As shown, the transceiver 160 may be internal, external, or a combination thereof to the housing 22. Further, the transceiver 160 may be a transmitter/receiver, receiver, or an antenna for example. Communication with various electronic devices, such as the smart device 42 or the server 46, and the transceiver 160 may be enabled by a variety of wireless methodologies employed by the transceiver 160, including 802.11, 3G, 4G, Edge, WiFi, ZigBee, near field communications (NFC), Bluetooth low energy and Bluetooth, for example. Also, infrared (IR) may be utilized.

The memory 156 and the storage 158 are accessible to the processor 154 and include processor-executable instructions that, when executed, cause the processor 154 to execute a series of operations. In one implementation of the processor-executable instructions, the processor 154 is caused to receive a command signal via the transceiver 160 and, responsive thereto, control the actuator 112 via the actuator input/output 162 per the command signal. The command signal may include a command to lower the cover material 34 over the sign 26 such that the cover material 34 is in a fully extended position. On the other hand, the command signal may include a command to raise the cover material 34 off of the sign 26 such that the cover material 34 is in a fully retracted position. The processor-executable instructions may then cause the processor 154 to receive state data from the actuator 112 via the actuator input/output 162. The state data may indicate the state of the actuator 112, with a known correlation existing between the state of the actuator 112 and the position of the cover material 34 relative to the sign.

The processor 154 may then receive sensor data from the signal sensor 60. The sensor data indicates the location of the cover material 34. The process may also receive event data from the proximity sensor 62. The event data indicates a railway event, such as the train 20 passing. The processor-executable instructions may then send a status report via the transceiver 160 to the smart device 42 or the server 46, for example. The status report may include the state data, the sensor data, the event data, or a subset thereof. The fixed signage 10 may send various data in the form of the status report or otherwise, and send the various data periodically, continuously, or in response to a request from the smart device 42 or the server 46, for example.

That is, in another implementation of the processor-executable instructions 178, the processor 154 is caused to receive a status request via the transceiver 160 from the smart device 42 or the server 46, for example. In response thereto, the fixed signage 10 sends the status report via the transceiver 160 to the smart device 42 or the server 46. The status report may include the state data, the sensor data, the event data, or a subset thereof. In a still further implementation of the processor-executable instructions, the processor 154 is caused to, in response to a railway event, send the status report via the transceiver 160. As previously discussed, the status report may include the state data, the sensor data, the event data, or a subset thereof.

Figure 8:
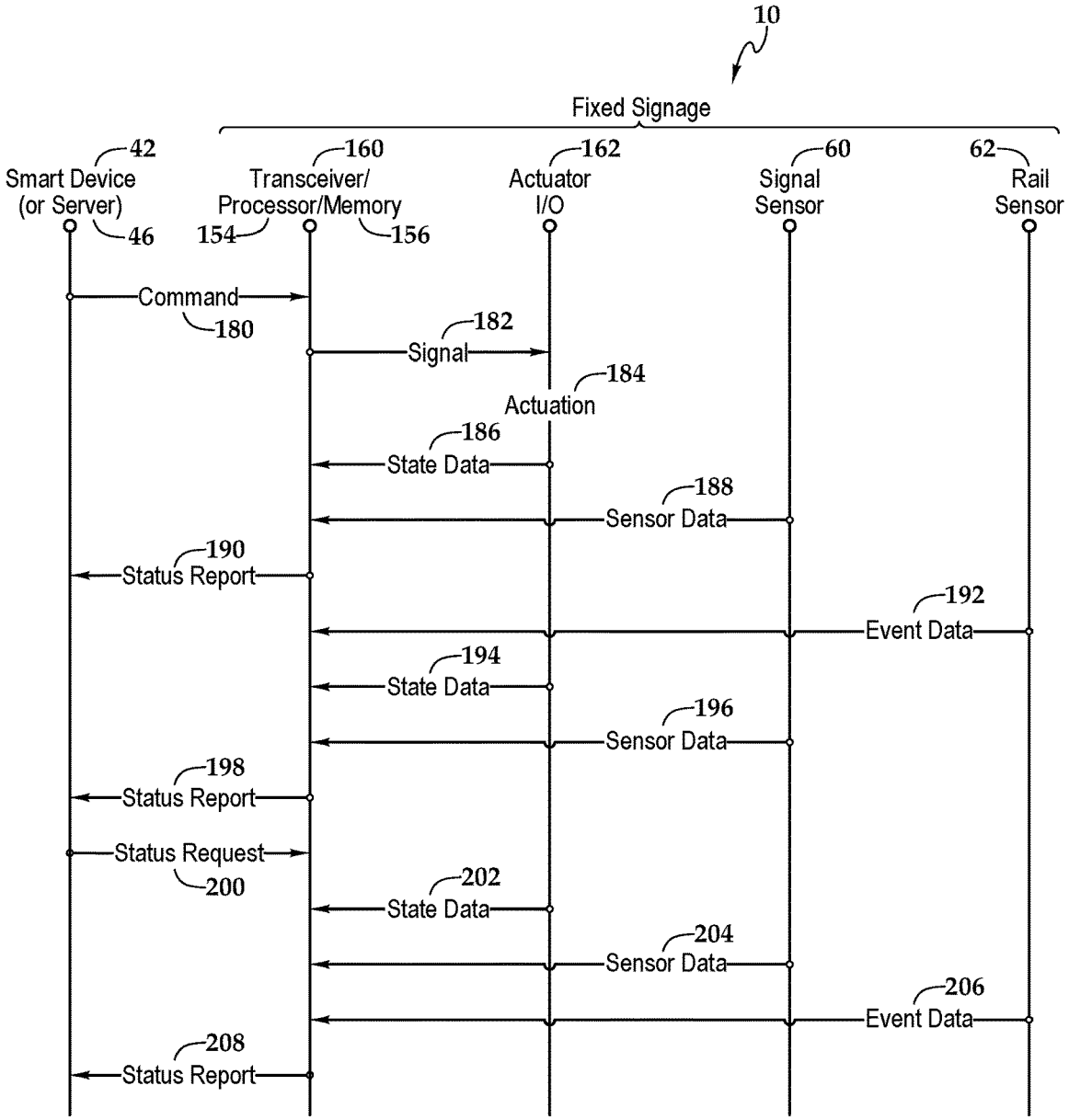
FIG. 8 is a signalization timing diagram depicting one embodiment of an operational process furnishing remote control and management of a fixed sign according to the teachings presented herein.

Referring now to FIG. 8, a signalization timing diagram depicting one embodiment of an operational process furnishing remote control and management of fixed signage 10 is presented. The smart device 42 or the server 46 sends a command signal 180 to the fixed signage 10, which is received by the transceiver 160. The command signal 180 may be an instruction to raise or lower the cover material 34 to respectively uncover or cover the sign 26. The processor 154 and the memory 156 process the command signal 180 and send a signal 182 to the actuator input/output 162, which results in an actuation 184 and the cover material 34 being raised or lowered. The actuator input/output 162 monitors the state of the actuator 112 and reports state data 186 to the processor 154 and the memory 156. Similarly, the signal sensor 60 monitors the movement and position of the cover material 34 and reports sensor data 188 to the processor 154 and the memory 156. The processor 154 and the memory 156 send, via the transceiver 160, a status report 190, which may confirm the actuation and provide the state data 186 and the sensor data 188.

The proximity sensor 62 monitors the railroad track 18 for a railway event, such as the passing of the train 20, and the proximity sensor 62 sends event data 192 to the processor 154 and the memory 156. The event data 192, such as the passing of the train 20, may provide the railway worker 40 with confirmation that the fixed signage 10 and train crew are operating, correcting, or the event data 192 may provide the railway work with confirmation of a problem, such as the train 20 passing signage indicating "STOP." As shown, the actuator input/output 162 monitors the state of the actuator 112 and reports state data 194 to the processor 154 and the memory 156. Similarly, the signal sensor 60 monitors the movement and position of the cover material 34 and reports sensor data 196 to the processor 154 and the memory 156. The event data 192, state data 194, and the sensor data 196 may then be provided in a status report 198 via the transceiver 160 to the smart device 42.

In further operations, the smart device 42 sends a status request 200 to the fixed signage 10. Responsive to the status request 200, the fixed signage 10 may utilize the actuator input/output 162 to monitor the state of the actuator 112 and report state data 202 to the processor 154 and the memory 156. The signal sensor 60 may be utilized to monitor the movement and position of the cover material 34 and report sensor data 204 to the processor 154 and the memory 156. Similarly, the proximity sensor 62 may be utilized to provide event data 206. The state data 202, the sensor data 204, and the event data 206 may then be provided in a status report 208 via the transceiver 160 to the smart device 42.

The order of execution or performance of the methods and data flows illustrated and described herein is not essential, unless otherwise specified. That is, elements of the methods and data flows may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A fixed signage (10) comprising:

a housing (22) having a front (80), rear (82), top (84), bottom (86), a first side (88), and a second side (90), the housing (22) sized to house a sign (26) therein, the sign (26) being a railway sign;

a window (24) located in the front (80) of the housing (22);

an actuator (112) being mounted in the housing (22);

a closure assembly (32) being installed in the housing (22), the closure assembly (32) including a frame (110) for supporting a cover material (34), the cover material (34) being moveable by a moveable closure member (138) between a fully retracted position whereat the cover material (34) is contained within the housing (22) such that the window (24) is exposed to a fully extended position whereat the cover material (34) covers at least a portion of the window (24);

the moveable closure member (138) being mounted within the frame (110) the moveable closure member (138) operating under the power of the actuator (112);

the housing (22) securing a processor (154), memory (156), a transceiver (160), an actuator input/output (162), a signal sensor (60), and a proximity sensor (62) therein;

a busing architecture (172) communicatively interconnecting the processor (154), the memory (156), the transceiver (160), the actuator input/output (162), the signal sensor (60), and the proximity sensor (62);

the actuator input/output (162) being located in communication with the actuator (112), the actuator input/output (162) configured to control the actuator (112);

the signal sensor (60) being located within the housing (22), the signal sensor (60) sensing a location of the cover material (34);

the proximity sensor (62) being located with the housing (22), the proximity sensor (62) oriented toward a sensing location proximate a ground at a railway right-of-way sign distance (66); and the memory (156) accessible to the processor (154), the memory (156) including processor-executable instructions that, when executed, cause the processor (154) to:

receive a command signal (180) via the transceiver (160), control the actuator (112) via the actuator input/output (162) per the command signal (180), receive state data (186) from the actuator (112) via the actuator input/output (162), the state data (186) indicating the state of the actuator (112), receive sensor data (188) from the signal sensor (60), the sensor data (188) indicating the location of the cover material (34), and receive event data (192) from the proximity sensor (62), the event data (192) indicating a railway event.

2. The fixed signage (10) as recited in claim 1, wherein the cover material (34) further comprises a flexible cover material.

3. The fixed signage (10) as recited in claim 1, wherein the fully extended position further comprises the cover material (34) fully covering the window (24).

4. The fixed signage (10) as recited in claim 1, wherein the fully extended position further comprises the cover material (34) partially covering the window (24).

5. The fixed signage (10) as recited in claim 1, wherein the railway event further comprises a train (20) passing.

6. The fixed signage (10) as recited in claim 1, wherein the processor-executable instructions further comprise processor-executable instructions that, when executed, cause the processor (154) to:

send a status report (190) via the transceiver (160), the status report (190) including the state data (186), the sensor data (188), and the event data (192).

7. The fixed signage (10) as recited in claim 1, wherein the processor-executable instructions further comprise processor-executable instructions that, when executed, cause the processor (154) to:

receive a status request (200) via the transceiver (160), and send a status report (190) via the transceiver (160), the status report (190) including the state data (186), the sensor data (188), and the event data (192).

8. The fixed signage (10) as recited in claim 1, wherein the processor-executable instructions further comprise processor-executable instructions that, when executed, cause the processor (154) to:

in response to a railway event, send a status report (190) via the transceiver (160), the status report (190) including the state data (186), the sensor data (188), and the event data (192).

9. A fixed signage comprising (10):

a housing (22) having a front (80), rear (82), top (84), bottom (86), a first side (88), and a second side (90), the housing (22) sized to house a sign (26) therein;

a window (24) located in the front (80) of the housing (22);

an actuator (112) being mounted in the housing (22);

a closure assembly (32) being installed in the housing (22), the closure assembly (32) including a frame (110) for supporting a cover material (34), the cover material (34) being moveable by a moveable closure member (138) between a fully retracted position whereat the cover material (34) is contained within the housing (22) such that the window (24) is exposed to a fully extended position whereat the cover material (34) covers at least a portion of the window (24);

the moveable closure member (138) being mounted within the frame (110), the moveable closure member (138) operating under the power of the actuator (112);

the housing (22) securing a processor (154), memory (156), a transceiver (160), an actuator input/output (162), and a signal sensor (60) therein;

a busing architecture (172) communicatively interconnecting the processor (154), the memory (156), the transceiver (160), the actuator input/output (162), and the signal sensor (60);

the actuator input/output (162) being located in communication with the actuator (112), the actuator input/output (162) configured to control the actuator (112);

the signal sensor (60) being located within the housing (22), the signal sensor (60) sensing a location of the cover material (34); and the memory (156) accessible to the processor (154), the memory (156) including processor-executable instructions that, when executed, cause the processor (154) to:

receive a command signal (180) via the transceiver (160), control the actuator (112) via the actuator input/output (162) per the command signal (180), receive state data (186) from the actuator (112) via the actuator input/output (162), the state data (186) indicating the state of the actuator (112), and receive sensor data (188) from the signal sensor (60), the sensor data (188) indicating the location of the cover material (34).

10. A fixed signage (10) comprising:

a housing (22) having a front (80), a rear (82), a top (84), a bottom (86), a first side (88), and a second side (90);

a window (24) located in the front (80) of the housing (22);

a sign (26) having secured within the housing (22), the sign (26) having a signifier (28) visible via the window (24), the sign (26) being mounted to a post (30) with fasteners (98) secured thereto through the rear (82) of the housing (22);

an actuator (112) being mounted in the housing (22);

a closure assembly (32) being installed in the housing (22), the closure assembly (32) including a frame (110) for supporting a cover material (34), the cover material (34) being moveable by a moveable closure member between a fully retracted position whereat the cover material is contained within the housing such that the window is exposed to a fully extended position whereat the cover material covers at least a portion of the window;

the moveable closure member (138) being mounted within the frame, the moveable closure member (138) operating under the power of the actuator (112);

the housing (22) securing a processor (154), memory (156), a transceiver (160), an actuator input/output (162), and a signal sensor (60) therein;

a busing architecture (172) communicatively interconnecting the processor (154), the memory (156), the transceiver (160), the actuator input/output (162), and the signal sensor (60);

the actuator input/output (162) being located in communication with the actuator (112), the actuator input/output (162) configured to control the actuator (112);

the signal sensor (60) being located within the housing (22), the signal sensor (60) sensing a location of the cover material (34); and the memory (156) accessible to the processor (154), the memory (156) including processor-executable instructions that, when executed, cause the processor (154) to:

receive a command signal (180) via the transceiver (160), control the actuator (112) via the actuator input/output (162) per the command signal (180), receive state data (186) from the actuator (112) via the actuator input/output (162), the state data (186) indicating the state of the actuator (112), and receive sensor data (188) from the signal sensor (60), the sensor data (188) indicating the location of the cover material (34).

* * * * *